US006988928B2

(12) United States Patent
Willett

(10) Patent No.: US 6,988,928 B2
(45) **Date of Patent: *Jan. 24, 2006**

(54) COMPACT MOTION MECHANISM FOR AN ANIMATED DOLL

(75) Inventor: William Willett, Irvine, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/865,439

(22) Filed: Jun. 9, 2004

(65) Prior Publication Data

US 2004/0253906 A1 Dec. 16, 2004

Related U.S. Application Data

(63) Continuation of application No. 10/075,174, filed on Feb. 12, 2002.

(60) Provisional application No. 60/268,317, filed on Feb. 12, 2001.

(51) Int. Cl.
*A63H 11/00* (2006.01)
*A63H 13/00* (2006.01)
*A63H 3/20* (2006.01)

(52) U.S. Cl. ..... 446/330; 446/301; 446/337; 446/343

(58) Field of Classification Search ..... 446/395, 446/268, 300, 301, 330, 337, 338, 342, 343, 446/344, 345, 346, 384, 391, 392
See application file for complete search history.

(56) References Cited

U.S. PATENT DOCUMENTS

| | | | | |
|---|---|---|---|---|
| 3,298,130 | A | | 1/1967 | Ryan |
| 3,364,618 | A | * | 1/1968 | Ryan et al. ..... 446/299 |
| 3,462,875 | A | | 8/1969 | May |
| 3,767,901 | A | | 10/1973 | Black et al. |
| 3,769,745 | A | | 11/1973 | Crosman |
| 3,912,694 | A | | 10/1975 | Chiappe et al. |
| 4,005,545 | A | * | 2/1977 | Ptaszek et al. ..... 446/341 |
| 4,033,071 | A | * | 7/1977 | Strongin et al. ..... 446/177 |
| 4,073,088 | A | | 2/1978 | Beny et al. |
| 4,139,968 | A | | 2/1979 | Milner |
| 4,177,589 | A | | 12/1979 | Villa |
| 4,203,259 | A | | 5/1980 | Haddock |
| 4,207,704 | A | | 6/1980 | Akiyama |
| 4,244,141 | A | | 1/1981 | Douglas et al. |
| 4,441,420 | A | | 4/1984 | Buan et al. |
| 4,526,060 | A | | 7/1985 | Watanabe |

(Continued)

FOREIGN PATENT DOCUMENTS

WO WO00/35548 6/2000

*Primary Examiner*—Boyer D. Ashley
*Assistant Examiner*—Ali Abdelwahed
(74) *Attorney, Agent, or Firm*—Kolisch Hartwell

(57) ABSTRACT

A tiny articulation eye and mouth (facial-expression structures) opening and closing structure installable in the hollow interior of a doll head, and utilizing a single, upright-axis motor, and a rotary, co-axial, stepped-diameter drive drum which is rotated by the motor. Circumferential drive tracks formed on the outside of the drum drive followers and actuation which directly impart opening and closing motions in the doll head's eyes and mouth.

27 Claims, 6 Drawing Sheets

U.S. PATENT DOCUMENTS

| | | | | | |
|---|---|---|---|---|---|
| 4,532,840 | A | | 8/1985 | Antonissen | |
| 4,579,542 | A | | 4/1986 | Mayer et al. | |
| 4,586,357 | A | | 5/1986 | Allweier et al. | |
| 4,678,930 | A | | 7/1987 | Mahon | |
| 4,767,374 | A | | 8/1988 | Yang | |
| 4,825,136 | A | | 4/1989 | Farhat | |
| 4,840,602 | A | | 6/1989 | Rose | |
| 4,843,497 | A | | 6/1989 | Leyden | |
| 4,850,930 | A | | 7/1989 | Sato et al. | |
| 4,900,289 | A | | 2/1990 | May et al. | |
| 4,995,600 | A | | 2/1991 | Kovac et al. | |
| 5,074,821 | A | * | 12/1991 | McKeefery et al. | 446/299 |
| 5,092,811 | A | * | 3/1992 | Bergenguer | 446/301 |
| 5,141,464 | A | | 8/1992 | Stern et al. | |
| 5,158,492 | A | | 10/1992 | Rudell et al. | |
| 5,191,615 | A | | 3/1993 | Aldava et al. | |
| 5,281,143 | A | | 1/1994 | Arad et al. | |
| 5,413,516 | A | | 5/1995 | Lam | |
| 5,520,566 | A | | 5/1996 | Lin | |
| 5,636,994 | A | | 6/1997 | Tong | |
| 5,820,441 | A | | 10/1998 | Pracas | |
| 5,833,513 | A | * | 11/1998 | Llorens | 446/354 |
| 5,855,502 | A | * | 1/1999 | Truchsess | 446/301 |
| 5,966,853 | A | * | 10/1999 | Yeh | 40/416 |
| 5,983,542 | A | * | 11/1999 | Chen | 40/411 |
| 6,048,209 | A | | 4/2000 | Bailey | |
| 6,053,798 | A | * | 4/2000 | Tang | 446/301 |
| 6,089,942 | A | | 7/2000 | Chan | |
| 6,149,490 | A | | 11/2000 | Hampton et al. | |
| 6,386,942 | B1 | * | 5/2002 | Tang | 446/301 |
| 6,497,607 | B1 | | 12/2002 | Hampton et al. | |
| 6,604,981 | B1 | * | 8/2003 | Sheng-Hung | 446/338 |
| 6,776,681 | B2 | * | 8/2004 | Willett | 446/300 |
| 2002/0111112 | A1 | * | 8/2002 | Willett | 446/330 |

* cited by examiner

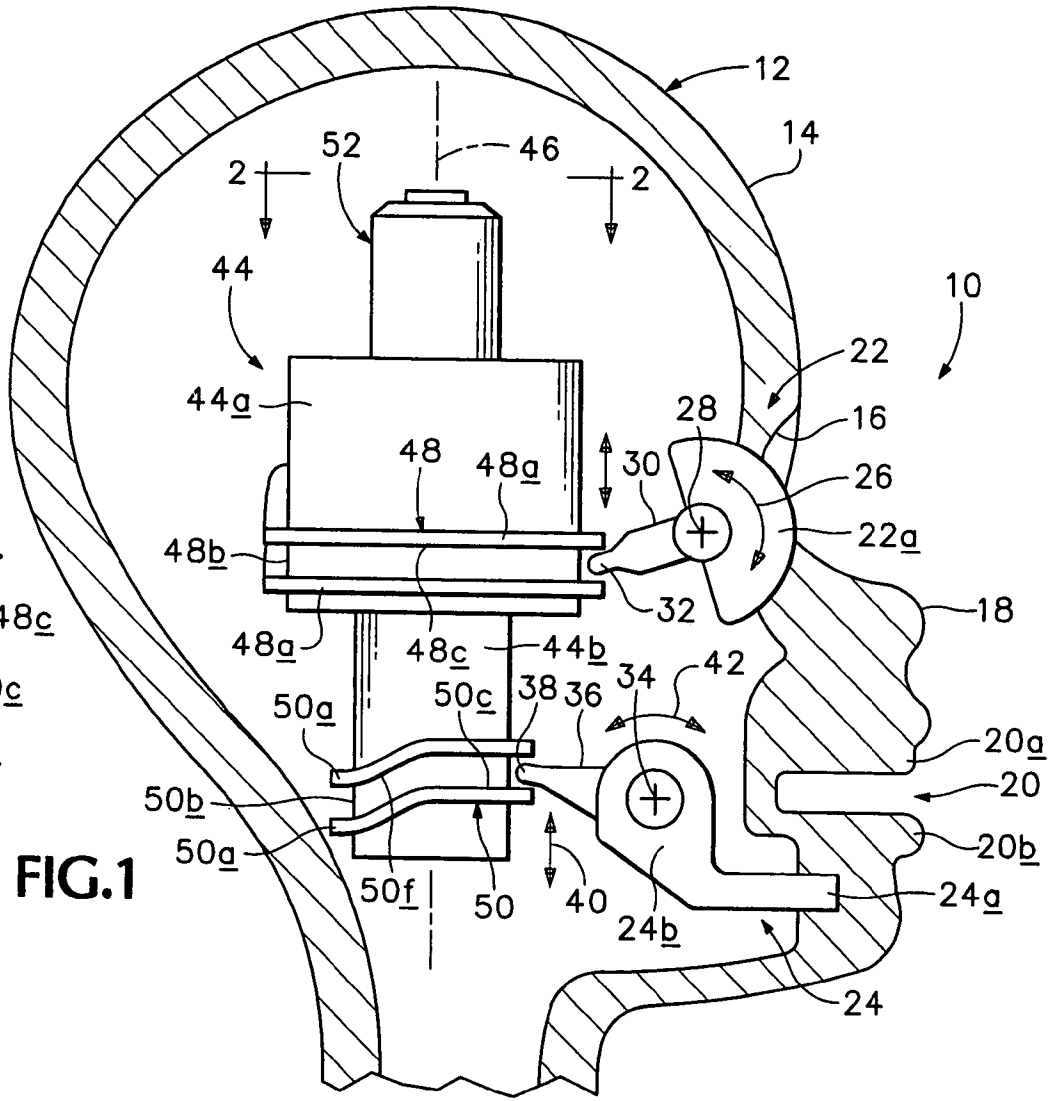
FIG.1
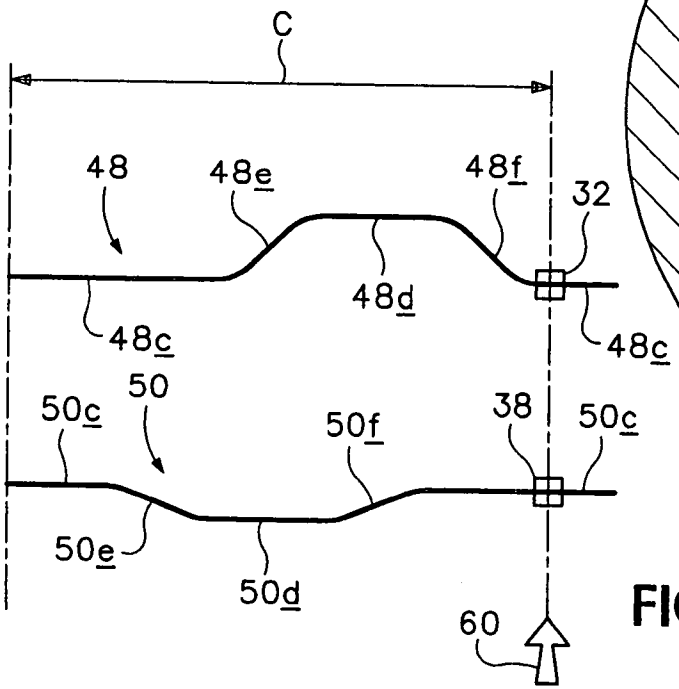

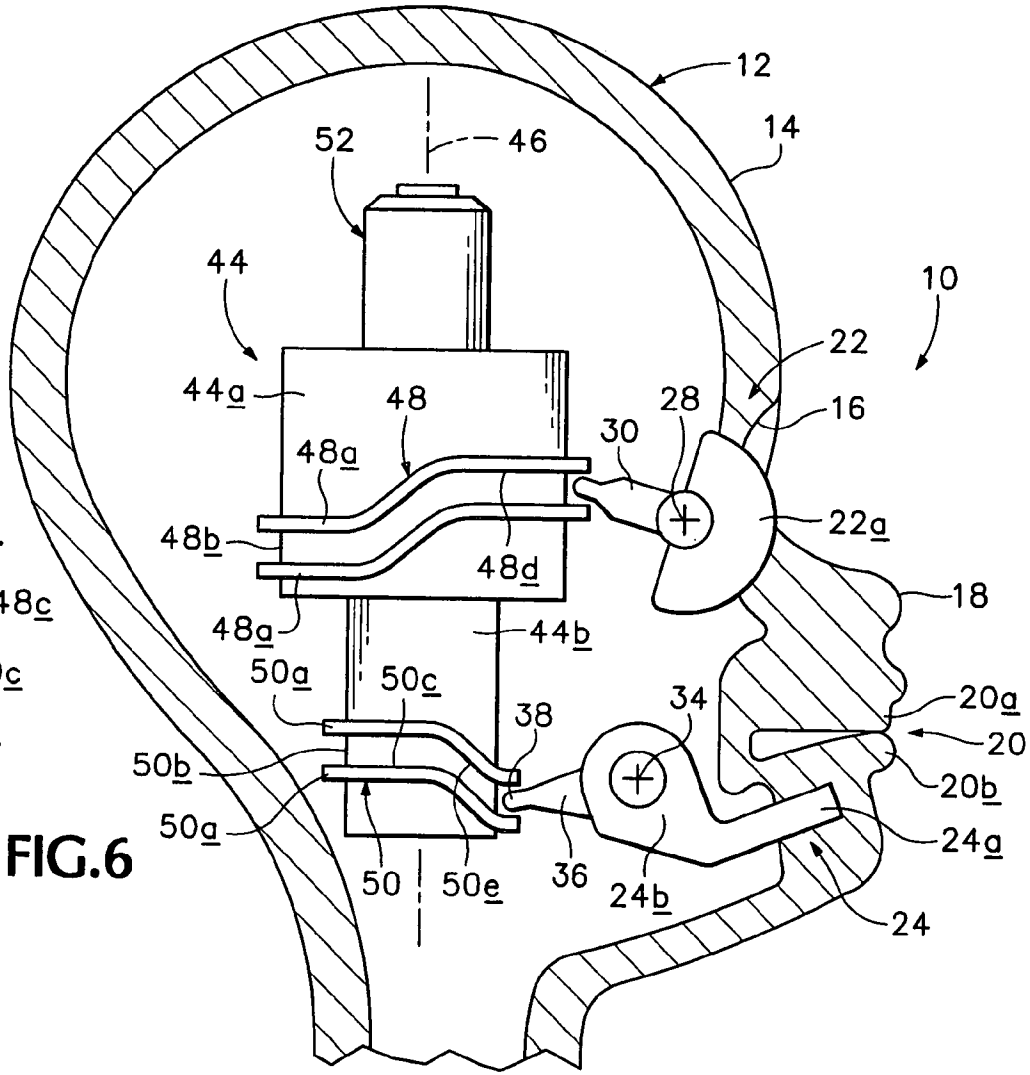
FIG.6
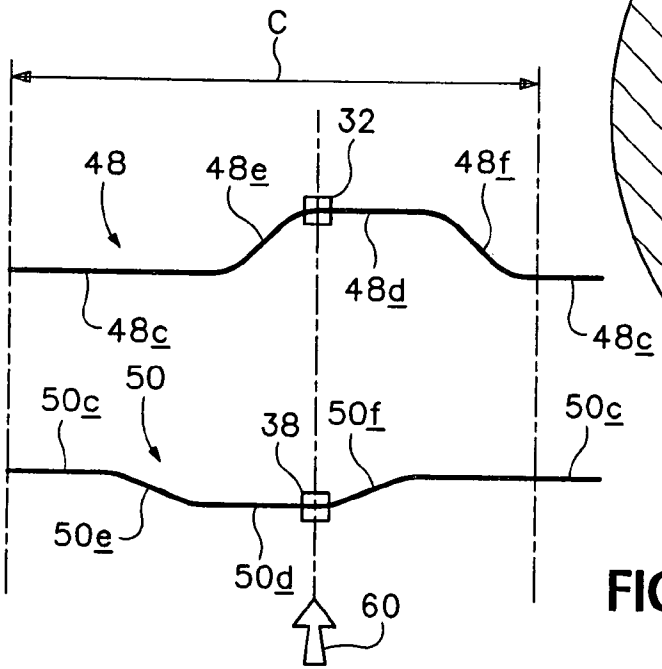

COMPACT MOTION MECHANISM FOR AN ANIMATED DOLL

CROSS-REFERENCE TO RELATED APPLICATIONS

This application is a continuation of U.S. patent application Ser. No. 10/075,174, filed Feb. 12, 2002 and entitled "Compact Motion Mechanism for an Animated Doll," which claims priority to U.S. Provisional Patent Application Ser. No. 60/268,317, filed Feb. 12, 2001 and entitled "Compact Mechanism for an Animated Doll," the entire disclosures of both applications are hereby incorporated by reference.

FIELD OF THE INVENTION

The present invention relates to a toy doll, and in particular, to a toy doll which has plural, movable facial-expression structures, such as openable and closeable eyes, and an openable and closeable mouth, operated under the influence of a compact single motor and drive mechanism which fits within the hollow interior of the head component in the doll. For illustration purposes, an embodiment of the invention is described herein with specific reference to movable eye and mouth structures—a setting wherein the invention has shown itself to offer particular utility the invention, as will become apparent, can offer similar utility in relation to other kinds of movable facial-expression structures.

BACKGROUND AND SUMMARY OF THE INVENTION

For many years, animated toy dolls have been popular toys for children. Over these years, more and more sophistication in design has been brought to bear upon the realistic nature of selected animated doll motions in relation to facial-expression structures, and in particular, to such motions which, in addition to appearing to be relatively natural, also occur in a pattern which is not easily learned very quickly by a child—an event which might too soon lessen the child's interest in continuing to play with a doll.

Various motorized or electronic dolls are shown in U.S. Pat. Nos. 3,298,130, 3,767,901, 3,912,694, 4,139,968, 4,207,704, 4,767,374, 4,825,136, 4,840,602, 4,900,289, 5,141,464, 5,158,492, 5,191,615, 5,281,143, 5,413,516, 5,636,994, 5,820,441, 6,048,209, and PCT Publication No. WO 00/35548, the disclosures of which are all incorporated herein by reference.

The present invention proposes a very compact, single-motor-driven animation structure effectively mounted within the hollow interior of a doll's head component for opening and closing the doll's eyes and mouth (facial-expression structures) in manners which are relatively realistic. Additionally, the animation structure of the present invention operates in a complex enough pattern that memorization of the pattern is not too likely, especially in the case of young children. The invention also proposes such an animation structure which, in relation to its compactness, is extremely simple, and which can be easily incorporated into an even very tiny doll head component such as, for example, a doll head which might be roughly the size of a golf ball.

These and other interesting features and contributions which are made by the present invention in the field of animated toy dolls will become more fully apparent as the description which now follows is read in conjunction with the accompanying drawings.

DESCRIPTION OF THE DRAWINGS

FIG. 1 is a simplified cut-away drawing of a toy doll (shown only fragmentarily) including a head component wherein movable eye and mouth structures are furnished and driven according to the present invention. In this figure, two graphical lines (a graphical representation) presented at the left side of the figure act as explanatory aids in describing motions that can be produced according to the invention in these eye and mouth structures.

FIG. 5 is very much like FIG. 1, except that, whereas FIG. 1 illustrates the movable eye and mouth structures in conditions with the eyes and the mouth both open, FIG. 5 shows a condition where the eyes are closed and the mouth is open.

FIG. 6 is like FIG. 1 and FIG. 5, except that here a condition is illustrated wherein the eyes and the mouth are both closed.

DETAILED DESCRIPTION OF, AND BEST MODE FOR CARRYING OUT, THE INVENTION

Figure 2:
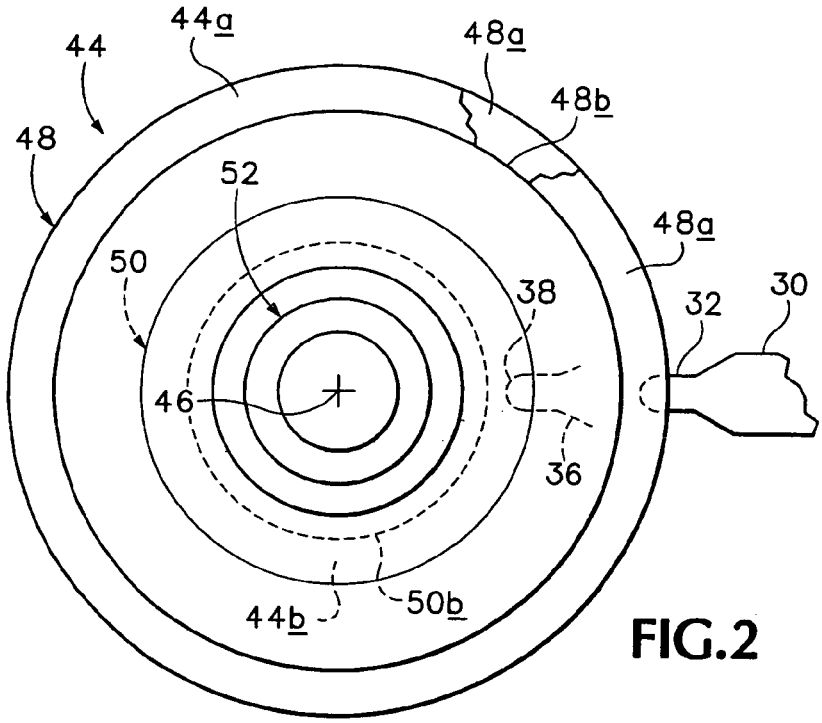
FIG. 2 is an enlarged, fragmentary, simplified plan view taken generally along the line 2-2 in FIG. 1.
Figure 3:
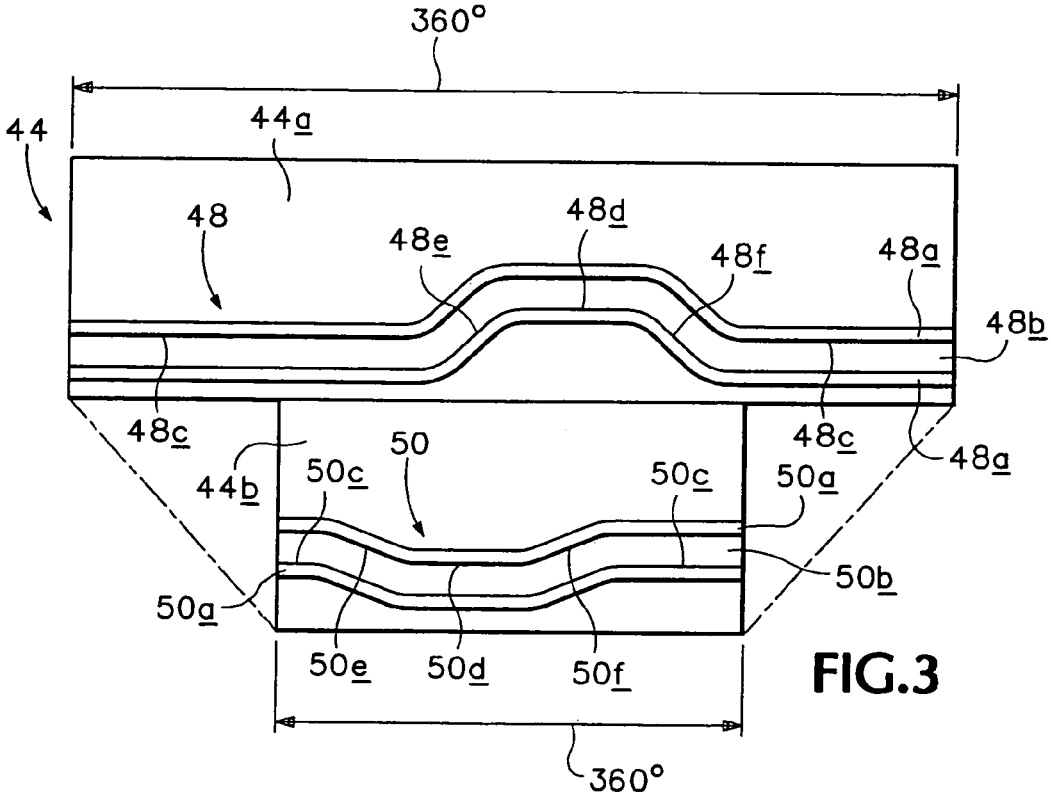
FIG. 3 is an unfolded (or developed) layout drawing of a rotary drive drum containing driver track structure which is constructed in accordance with the present invention.
Figure 7:
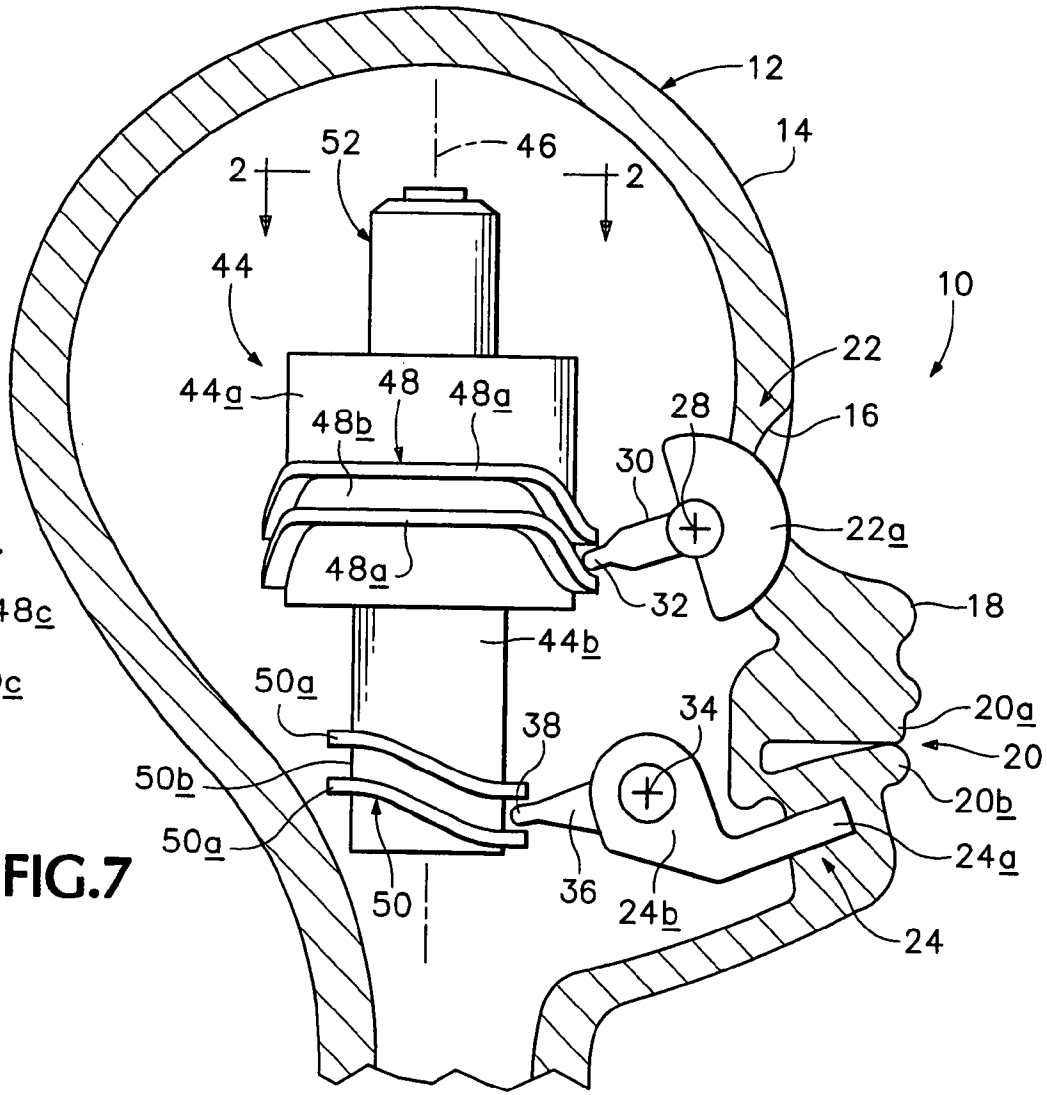
FIG. 7 is similar to FIGS. 1, 5 and 6, but illustrates yet another condition in the doll wherein the eyes are open and the mouth is closed.
Figure 7:
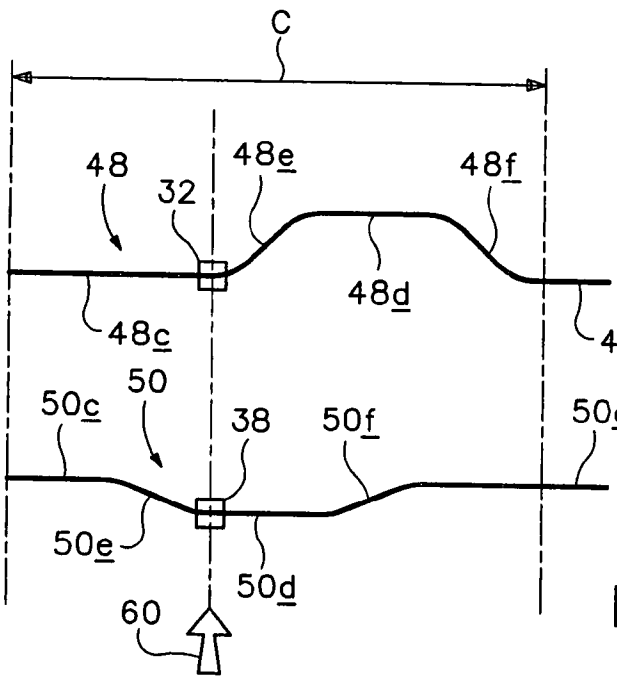

Turning now to the drawings, and referring first of all most particularly to FIGS. 1, 2 and 3, illustrated generally at 10 is a fragmentary portion (the head portion) of a toy doll which includes a hollow, typically plastic, molded head component 12. In doll 10, head component 12 is the size roughly of a conventional golf ball. The facial features of this doll head include a forehead 14, eye openings, such as the single eye opening shown at 16, a nose 18, and a mouth 20 which, in FIG. 1, is shown in an open condition. Preferably, the structural material which makes up head component 12 is sufficiently flexible, at least in the region of mouth 20, to enable reasonably realistic opening and closing motion in this region, so that a closed condition for the mouth, such as is illustrated in FIGS. 6 and 7, can be achieved simply by producing relative closing motion between the upper and lower lip structure 20*a*, 20*b*, respectively, in mouth 20.

Provided in accordance with the present invention are two articulated-motion, facial-expression structures including an eye structure 22 and a mouth structure 24 which are mounted and disposed within the hollow interior of head component 12.

Eye structure 22 includes a pair of generally hemispherical movable eye components, such as the single eye component shown at 22*a* in FIG. 1. These eye components, that are also collectively referred to herein as motion eye structure, are pivotally mounted for rotation reversibly, as indicated generally by double-ended curved arrow 26 in FIG. 1, on a pivot axis 28. Shown at 30, joined to component 22*a*, and to its counterpart which is hidden in FIG. 1 behind component 22*a*, is a single, elongate actuator which extends radially away from axis 28, on the opposite side of this axis from the two eye components. The left end of actuator 30 in FIG. 1 includes what is referred to herein as a track follower 32.

With up and down motion imparted to follower 32, the actuator rotates the eye structure as indicated by arrow 26 about pivot axis 28, between what is already been referred to herein as open and closed conditions. When the follower and actuator structures are in the positions generally shown for them in FIG. 1, the eye structure sits in what can be thought of as its counterclockwise motion limit condition, which condition defines the mentioned open condition to the eye structure. With upward motion in follower 32, and related motion in actuator 30, the eye structure rotates clockwise about axis 28 in FIG. 1 toward, and finally ending at, a condition similar to that shown in FIG. 5, wherein the eye structure is closed. In this situation, the eye structure is in its clockwise motion limit condition.

Mouth structure 24 includes an elongate extension element 24*a* which is disposed appropriately within head component 12 in the region just beneath lower lip 20*d*. Element 24*a* directly connects as shown to the lower lip portion 20*d* in the mouth structure. Extension element 24*a* extends from a body 24*b* which is appropriately pivoted on the inside of head component 12 for reversible rotation about an axis shown at 34 in FIG. 1. Axis 34 is disposed below and generally parallel to axis 28, and both of these axes are oriented substantially normal to the plane of FIG. 1. Provided for mouth structure 24 is an elongate actuator extension 36 which has, at its outer end, a track follower 38. With up and down movement of follower 38, as generally indicated by double-ended arrow 40, actuator 36 moves in such a fashion as to cause reversible, limited-angle rocking of the mouth structure about axis 34, such rocking being indicated in FIG. 1 by double-ended, curved arrow 42. This rocking motion is delivered to the mouth lower lip through element 24*a*.

With the various components in and associated with mouth structure 24 in the positions illustrated for them in FIG. 1, the mouth structure sits in what can be thought of as its most clockwise rotated condition, and creates an open condition for mouth 20. When this mouth-associated structure is rocked counterclockwise in FIG. 1 to another rotation limit condition, such as that which is pictured in FIGS. 6 and 7, the mouth structure places mouth 20 in a closed condition.

Illustrated at 44 in FIG. 1 is a two-diameter (or stepped-diameter) cylindrical drive drum body, or rotary drive device, which has an upright long axis shown at 46, and which includes upper and lower, different-diameter end portions 44*a*, 44*b*, respectively. Drum 44 is also referred to herein as a rotary interconnect structure. Drum body 44, which is also referred to herein as a shared rotary drive device, is suitably mounted within the hollow interior of head component 12 for rotation about axis 46. End portions 44*a*, 44*b* are also referred to herein as cylindrical elements.

Appropriately formed on, and extending generally circumferentially in a kind of continuous closed-loop fashion about upper drum body end 44*a*, is an elongate circumferential track 48. This track is defined by upper and lower, spaced, generally parallel walls 48*a* which define opposite sides of a track groove 48*b*. Similarly formed on and circumferentially with respect to lower drum body end 44*b* is another elongate, generally circumferential, closed-loop track 50 which includes spaced side walls 50*a* that define a track groove 50*b*. Tracks 48, 50 constitute rotary track instrumentalities herein.

Further included within the hollow interior of head component 12 according to the invention is a single, small electrical drive motor 52. Motor 52 is appropriately, drivingly connected to rotate drum 44 about axis 46. The drive axis of motor 52 is substantially coincident with axis 46. Suitable electrical connections (not shown) are provided for operating motor 52 from an "on board" electrical power source, such as a battery. Motor 52 may be operated, selectively, either always in one rotary direction only, or, if so desired, reversibly in both directions, and in any one of a number of different rotational patterns over time. These operational patterns which may be selected for motor 52 do not form any part of the present invention, and can be implemented according to designer wishes. In the particular structure now being described, motor 52 is constructed to operate unidirectionally, at a fairly constant speed, and in successive, merge-connected cycles which last throughout a time period selected by the person playing with the toy. Such selection can be implemented either through the closure of an appropriate electrical circuit switch, or may result from other activities such as positional movements, external sounds, etc. None of these considerations also forms any part of the present invention. The stopping of action can occur by opening of the activation circuit either manually with a switch, or automatically after some period of time, some preset number of cycles, the ending of some event which has triggered operation in the first place, or in many other ways.

Looking for a moment at FIG. 2 along with FIG. 1, one can see in FIG. 2 generally the relative dispositions of motor 52 and drum 44 from an above point of view taken downwardly along axis 46. Follower 32 on the outer end of actuator 30 is seen extending into groove 48*b* in track 48. Similarly, follower 38 on the outer end of actuator 36 can be seen to be extending into groove 50*b* provided in track 50. Motor 52 is also shown in FIG. 2. So also is rotational axis 46.

FIG. 3 represents a developed, or flattened out, symbolic view of the upper and lower end regions of drum 44. Here one can see generally how tracks 48, 50 are arranged on these two different-diameter drum ends.

In FIG. 1, and referring now to the graphical image that is presented at the left side in this figure, the dimension C shown there represents the full 360° angular lengths of tracks 48, 50. The reason that the graphical image now being discussed in FIG. 1 looks somewhat different from the mechanical developed view pictured in FIG. 3, is that FIG. 3 actually shows the circumferential relative linear lengths (or dimensions) of tracks 48, 50, whereas the graphical image in FIG. 1 shows the angular circumferential dimensions that relate these two tracks. One can see that, within track 48, there is one region 48*c* which is the lower-most region pictured in FIG. 1, and another region 48*d* which is the upper-most region in this track. These two regions are spaced relative to the direction of the longitudinal axis of drum 44, and are joined through angular transition regions (two of them) shown at 48*e*, 48*f*. Region 48*c* is referred to herein also as a low region in track 48, and region 48*d* as a high region in the track.

Track 50 is somewhat similar in that it includes two longitudinally-spaced regions—an upper region 50*c* and a lower region 50*d*, connected through angular transition regions shown at 50*e*, 50*f*. Region 50*c* constitutes a high region in track 50, and region 50*d* a low region in this track.

Figure 5:
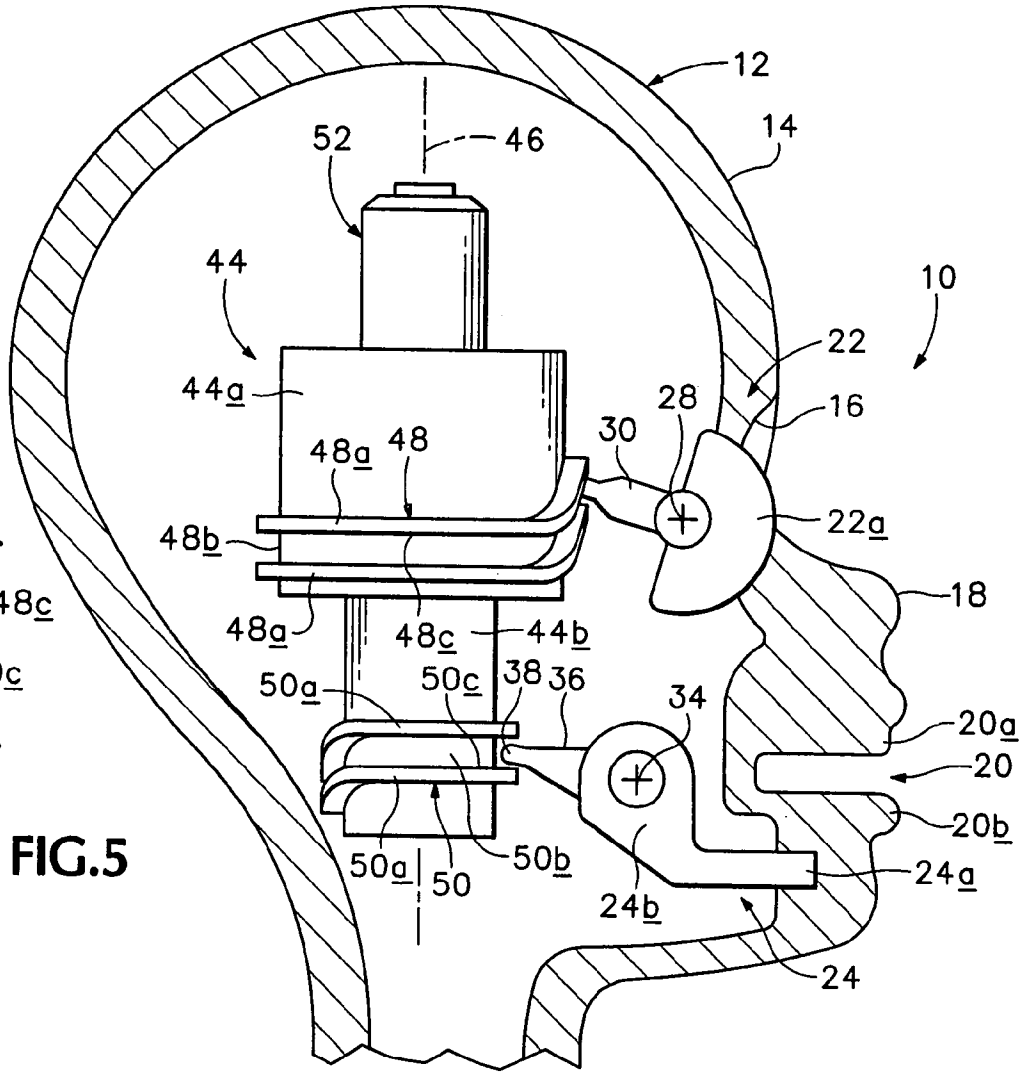
Figure 5:
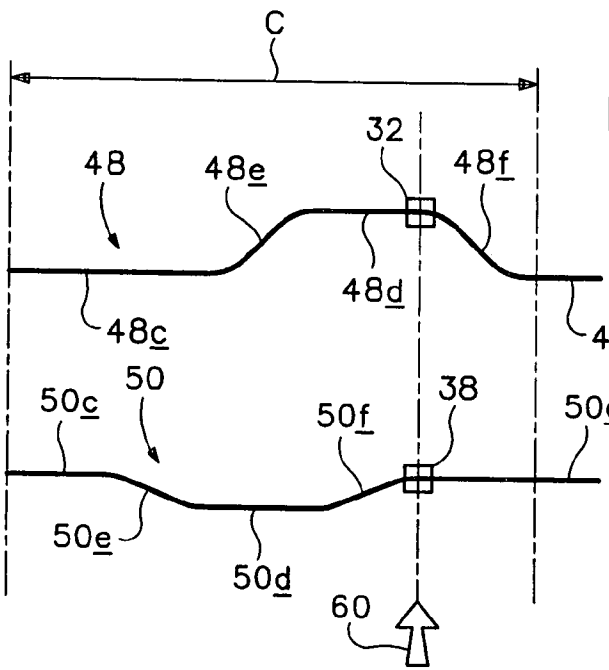

As will shortly become apparent, FIGS. 5, 6 and 7 include, at their respective left sides, graphical representations like the one shown in FIG. 1. These other graphical representations each relate to the eye and mouth conditions specifically pictured in the associated figure.

With the structure of this invention organized as pictured mechanically in FIGS. 1–3 and 5–7, inclusive, during each complete, single, rotary cycle created in drum 44 by motor 52, followers 32, 38 follow the paths defined by tracks 48, 50, respectively. The result of this is that these followers shift generally upwardly and downwardly in FIG. 1, with pauses occurring between successive upward and downward motions, to cause related opening and closing rocking motions in eye structure 22 and in mouth structure 24, along with periods of no eye or mouth movements.

Figure 4:
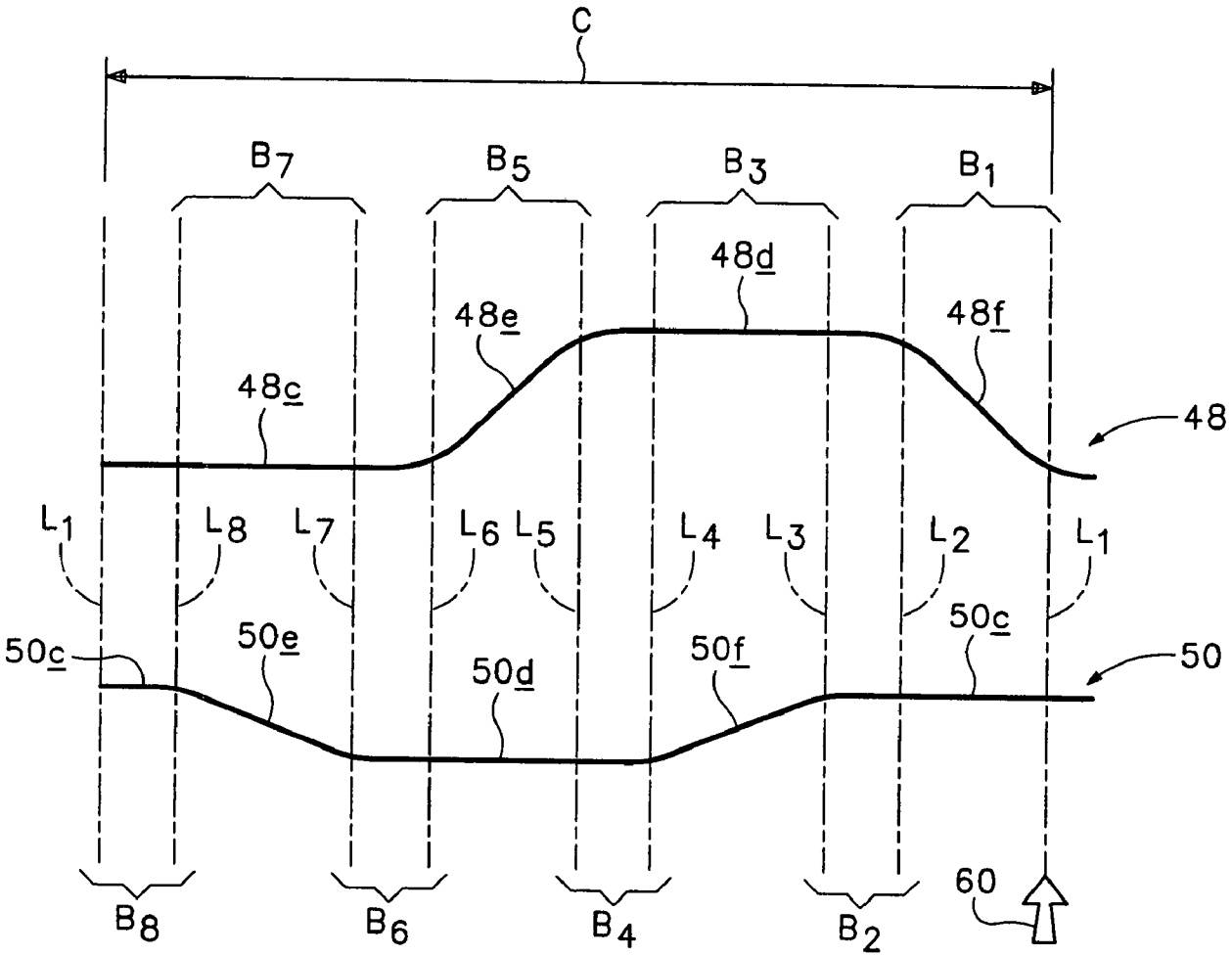
FIG. 4 is a graphical drawing which is similar to the one shown at the left side in FIG. 1, specifically illustrating different phases of motion and positioning in a single cycle of eye and mouth movement produced according to the invention.

Turning at this point to FIG. 4 in the drawings, and further describing the motion activity just referred to, a complete, single 360° cycle of rotation for drum 44 is illustrated. This cycle defines, effectively, eight different kinds of positional changes and behaviors that are created by tracks 48, 50 for followers 32, 38, respectively. The general "boundaries" of these eight phases are marked by dash-dot vertical lines in FIG. 4, and the lengths of the respective phases are marked by brackets provided in this figure. The dash-dot lines in FIG. 4 are labeled L1–L8, inclusive, and the brackets, which define the nominal spans of these phases, are shown at B1–B8, inclusive.

A single cycle of unidirectional operation will now be described in the context of considering that motor 52 rotates drum 44 in a clockwise direction as pictured in FIG. 2. This context further includes that followers 32, 38 are positioned in track grooves 48*b*, 50*b*, respectively, at a moment in time just at the end of that phase (or condition) in which both the eye and the mouth structures have been held open (paused) for a period of time during motor operation. This is the status of things pictured in FIG. 1.

Illustrated in each of the graphical image portions of FIGS. 1, 5, 6 and 7 is an upwardly pointing arrow 60 which represents a laterally-moving cursor that points to the regions along tracks 48, 50 then occupied by followers 32, 38, respectively. The cycle description now to be given, with clockwise rotation imparted as just described to the drum, causes cursor 60 effectively to progress in a left-moving direction in the graphical presentations provided in FIGS. 1, 5, 6 and 7. It is for this reason that the labeling described above the dashed-dot lines, and the brackets shown in FIG. 4, are given ascending numbers in a progression which is to the left in FIG. 4 along tracks 48, 50.

At the beginning of the single operating cycle now to be described, the physical positions and conditions of the various components are as pictured in FIGS. 1, 2 and 3. Followers 32, 38 ride in tracks 48, 50, and specifically are positioned in these tracks (as indicated in FIGS. 1, 2 and 3) with the eye structure and the mouth structure each open. The angular positions of the two followers under these circumstances are especially illustrated in the graphical illustration at the left side of FIG. 1, where cursor arrow 60 points to the positions of these two followers along tracks 48, 50.

With clockwise rotation produced by motor 52 in drum 44, relative motion occurs between tracks 48, 50 and cursor 60. In particular, this relative motion is such that the cursor moves to the left simultaneously and equiangularly relative to these two tracks. Put another way, the two tracks move as a unit relatively to the right of cursor 60 in FIG. 1. In the several illustrations (FIGS. 1, 5, 6 and 7) herein which employ such graphical representations, the positions of the tracks are retained roughly in the same relative location regarding the pictured cut-away head structure, and cursor 60 is shown in respective conditions moved to different angular locations which are to the left of the condition for the cursor shown in FIG. 1.

Considering now FIG. 4 along with these other figures as an aid in reviewing the operation of the apparatus of this invention, cursor 60 is shown in FIG. 4 in the same position (phase) angularly relative to tracks 48, 50 in which it is shown in FIG. 1. In this phase of a single cycle of operation of the apparatus of the invention, and as has been mentioned earlier, both the eye structure and the mouth structure are in open conditions. Follower 32 sits in low region 48*a* within track 48 and follower 38 sits within high region 50*c* in track 50 (see dash-dot line L1). As will become apparent, this positional condition for the followers, the actuators, and the eye and mouth structures exists at the end of one of the basically eight different phases of conditions in the apparatus of the invention, and specifically, at the end of a phase wherein both the eye and mouth structures remain essentially stationary and both in open conditions.

As rotation in drum 44 now progresses, follower 32 begins to ride upwardly as urged and guided by inclined region 48*f* in track 48, and follower 38 remains basically in the same vertical position in the next stretch of track 50. This phase of operation, wherein the mouth structure remains open and the eye structure begins to close, is pictured by bracket B1 in FIG. 4. When rotation has taken place angularly to a point which represents the "end" of phase B1 (see dash-dot line L2), follower 32 now sits in high region 48*d* in track 48, while follower 38 still resides in high region 50*c* in track 50. In this set of conditions, the eye structure is closed and the mouth structure open. This condition is pictured in FIG. 5.

There now ensues a phase of operation B2 where, for a period of time, the eye structure remains closed and the mouth structures remains open. This phase begins at line L2 in FIG. 4, ends at line L3, and is reflected by bracketed region B2. Thus, and as was true in the very first phase of operation, the end of which began this description, both the eye and the mouth structure are once again in nonmoving conditions.

At the end of phase B2, follower 32 remains in high region 48*d* of track 48, and follower 38 begins descending in downwardly inclined ramp portion 50*f* in track 50. This phase of operation, which ends at dash-dot line L4 in FIG. 4, is marked by bracket B3 in FIG. 4. This is a phase of operation during which the eye structure remains closed while the mouth structure moves, and specifically moves from an open condition toward a closed condition. This latter condition is pictured in FIG. 6 in the drawings.

At the end of phase B3, follower 32 is still in high region 48*d* in track 48, and follower 32 is now in low region 50*d* in track 50, with the result that the eye structure is still closed, and the mouth structure is now also closed.

Dash-dot line L4 marks the beginning of the next phase B4 in the condition of the apparatus of this invention—a phase which ends with dash-dot line L5. In phase B4, both the eye structure and the mouth structure remain stationary, with the eye structure closed and the mouth structure also closed. This is the FIG. 6 condition.

The next phase to follow is pictured at B5 in FIG. 4, beginning with dash-dot line L5 and ending with dash-dot line L6 in the figure. During this phase, follower 32 is moved downwardly along downwardly inclined portion 48*e* in track 48, while follower 38 remains unmoved in low region 50*d* in track 50. Thus, during phase B5, the eye structure changes from a closed to an open condition while the mouth structure remains closed.

At the end of phase B5, a condition exists where follower 32 is now again in low region 48*c* in track 48, while follower 38 is still also in low region 50*d* in track 50. There then follows a phase marked B6 in FIG. 4, beginning with dash-dot line L6 and ending with dash-dot line L7. During phase B6 both the eye and the mouth structures are stationary, with the eye structure open and the mouth structure closed. This condition is illustrated in FIG. 7 in the drawings.

What next follows is a phase marked B7 in FIG. 4 during which phase follower 32 remains in low region 48*c* in track 48, while follower 38 begins to move upwardly under the influence of rising ramp portion 50*e* in track 50. This is a phase during which the eye structure remains open, while the mouth structure transitions from a closed to an open condition. At the end of phase $B_7$, the components in the apparatus of this invention, vis-a-vis the conditions (open or closed of the eye structure and the mouth structure), are the same as those which existed at the beginning of this described single cycle of operation. The phase of operation during which this exists is pictured by bracket $B_8$ in FIG. 4. This phase begins with dash-dot line $L_8$ and ends with previously-mentioned dash-dot line $L_1$ which, because of the developed-view nature of FIG. 4, appears both at the left and right sides of this figure. During phase $B_8$, follower 32 remains in low region 48*c* in track 48, while follower 38 remains in high region 50*c* in track 50. In this phase, both the eye and the mouth structures are held stationary in open conditions.

It can thus be seen how, in a single, unidirectional cycle of rotation and operation of motor 52 and drum 44, a fairly complex and quite natural series of phases of eye openings, eye closings, mouth openings, mouth closings, accompanied by times when both the eyes and mouth are stationary in respective different open or closed conditions, takes place. The operation specifically described contains generally eight different phases of operation, with four phases involving nonmoving conditions in the eye structure and mouth structure, interleaved by four other phases where one but not the other one of these two structures is put into motion between an open and a closed condition, or vice versa.

The pattern of operation just described can also be seen to be one which is not easily quickly memorized, and one which, depending upon the particular starting set of positions for the various components in the mechanism of this invention, cannot easily be predicted—vis-a-vis what is next to happen. This statement, of course, assumes that operation of the apparatus of the invention can be stopped at any point in any one of its different phases, and this is an operating condition which the invention readily accommodates, and which is truly a matter of designer choice. Another option, of course, would be to have the components of the mechanism of this invention always advance to and stop in a particular selected starting and stopping condition each time that it is started and stopped. Other patterns of operation can, of course, be chosen at the selection of a designer of a doll employing this invention.

Further, the patterns described by tracks 48, 50 on and around the circumferences of drum ends 44*a*, 44*b*, can take on a host of different characteristics to produce a very different set, or very different sets, of patterns of interrelated opening and closing operations for the eye and mouth structures. For example, the number of times that opening and closing occurs in a single 360° turn of drum 44, and the angular rotational conditions during which changes takes place, or constancy holds, can be modified easily from design to design. So also can be the amount of vertical travel produced in the followers by vertical changes in the angular positions of the relative associated tracks.

The fact that, in the mechanism proposed by this invention, the up and down directions in which the followers move is mimicked by the up and down movements of the eye and mouth structures leads to overall simplicity in the structure of the invention. By stepping the diameter of the different drum regions that carry tracks, and by selecting the locations of horizontal pivot axes 28, 34, and all in relation to, selecting the lengths of actuators 30, 36, the apparent relative amounts of opening and closing motions that are producable in the eye and mouth structures are readily varied from design to design.

The structure of this invention, as can clearly be seen, involves a very few, relatively simply manufactured components, which may be molded plastic components. Also, the invention requires only a single, tiny electrical drive motor. These factors yield a structure which is easily miniaturized enough to fit within the hollow interior of an even very small doll head.

Without making any appreciable changes in the mechanical constructions of the eye and mouth structures, the actuators, the followers, the drum and the tracks herein, but simply by allowing motor 52 to operate bidirectionally, either by direct user selection, or in scheduled alternation, or even in random alteration, the patterns of eye structure and mouth structure openings and closings can be made to be far more complex. Such further complexity would thus make it far more difficult, almost to the point of impossibility, to predict what the next action will be, particularly on start-up of motion if that start-up is also initiated in a kind of random fashion.

Accordingly, a unique animated doll head mechanism, with a sophisticated, difficult to memorize and yet quite realistic set of motions, all employable in very tiny doll head structures, is proposed by the present invention. This mechanism, while offering, as stated earlier herein, special utility with respect to working with movable eye and mouth structures, can also be employed to work with other kinds of facial-expression structures.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. An animated toy doll, comprising:

a head including a top and a bottom defining a vertical axis;

plural, changeable-position, movable facial-expression structures pivotally mounted to the head; and a shared rotary drive device rotatably disposed within the head, wherein the drive device is configured to rotate in plural directions around an upright long axis that is parallel to the vertical axis, and to move each of the facial-expression structures, as the drive device rotates in any one of the plural directions, producing plural position-changing motions in each of the facial-expression structures, wherein the shared rotary drive device includes a cylindrical drive drum body having different-diameter upper and lower portions and configured to rotate around the upright long axis, and wherein the facial-expression structures are configured to pivot around plural pivot axes and the plural pivot axes are at least substantially perpendicular to the upright long axis, and wherein the cylindrical drive drum body is operatively connected to the facial-expression structures such that rotary movement of the cylindrical drive drum body directly translates to pivotal movement of the facial-expression structures.

2. The doll of claim 1, wherein the facial-expression structures include eye and mouth structures.

3. The doll of claim 2, wherein the cylindrical drive drum body is configured to move each of the eye and mouth structures.

4. The doll of claim 1, wherein the facial-expression structures include elongate actuators.

5. The doll of claim 4, wherein the cylindrical drive drum body is configured to pivotally move the elongate actuators.

6. The doll of claim 1, wherein the facial-expression structures include first and second facial-expression structures, and the upper portion of the cylindrical drive drum body is configured to pivotally move the first facial expression structure and the lower portion of the cylindrical drive drum is configured to pivotally move the second facial expression structure.

7. The doll of claim 6, wherein the first facial-expression structure includes an eye structure and the second facial-expression structure includes a mouth structure.

8. The doll of claim 1, wherein the facial-expression structures include elongate actuators, and the cylindrical drive drum body is configured to pivotally move the elongate actuators.

9. The doll of claim 8, wherein the cylindrical drive drum body includes plural elongate circumferential tracks.

10. The doll of claim 9, wherein the elongate actuators include followers that extend into the plural tracks, and the plural tracks are configured to pivotally move the followers.

11. The doll of claim 9, wherein the plural elongate circumferential tracks include a first track and a second track, and the upper portion includes the first track and the lower portion includes the second track.

12. The doll of claim 1, further comprising a motor disposed within the doll and drivingly connected to the shared rotary drive device, wherein the motor is configured to rotate the shared rotary drive device.

13. An animated toy doll, comprising:

a head including a top and a bottom defining a vertical axis;

eye and mouth structures pivotally mounted to the head, wherein the eye and mouth structures are configured to pivot between open and closed positions that are around plural pivot axes;

a single shared rotary drive device rotatably disposed within the head, wherein the drive device is configured to rotate around an upright long axis that is parallel to the vertical axis, and wherein the shared rotary drive device includes plural elongate circumferential tracks that are operatively connected to the eye and mouth structures such that rotary movement of the shared rotary drive device translates to pivotal movement of the eye and mouth structures; and a motor disposed within the doll and drivingly connected to the shared rotary drive device, wherein the motor is configured to rotate the shared rotary drive device.

14. The doll of claim 13, wherein the eye and mouth structures include elongate actuators, and the plural elongate circumferential tracks are configured to pivotally move the elongate actuators.

15. The doll of claim 13, wherein the shared rotary drive device includes a cylindrical drive drum body configured to rotate around the upright long axis.

16. The doll of claim 15, wherein the cylindrical drive drum body includes different-diameter upper and lower portions.

17. The doll of claim 16, wherein the plural elongate circumferential tracks includes a first track and a second track, and wherein the upper portion of the cylindrical drive drum body includes the first track that is configured to pivotally move the eye structure, and the lower portion of the cylindrical drive drum body includes the second track that is configured to pivotally move the mouth structure.

18. The doll of claim 15, wherein the eye and mouth structures include elongate actuators, and the plural elongate circumferential tracks are configured to pivotally move the elongate actuators.

19. The doll of claim 18, wherein the cylindrical drive drum body includes the plural elongate circumferential tracks.

20. The doll of claim 19, wherein the elongate actuators include followers that extend into the plural tracks and the plural tracks are configured to pivotally move the followers.

21. An animated toy doll, comprising:

a head including a top and a bottom defining a vertical axis;

plural facial-expression structures pivotally mounted and disposed within the head, wherein the plural facial-expression structures are configured to pivot around plural pivot axes at least substantially perpendicular to an upright long axis; and a single shared cylindrical drive drum body rotatably disposed within the head, wherein the drum body is configured to rotate around the upright long axis that is parallel to the vertical axis and to pivotally move each of the plural facial-expression structures, and wherein the shared cylindrical drive drum body includes at least one driver track structure that is operatively connected to the facial-expression structures such that rotary movement of the shared cylindrical drive drum body translates to pivotal movement of the plural facial-expression structures.

22. The doll of claim 21, wherein the plural facial-expression structures include eye and mouth structures.

23. The doll of claim 22, wherein the at least one driver track structure is configured to move each of the eye and mouth structures.

24. The doll of claim 21, further comprising a motor disposed within the doll and drivingly connected to the cylindrical drive drum body, wherein the motor is configured to rotate the cylindrical drive drum body.

25. The doll of claim 24, wherein the motor is disposed within the head.

26. The doll of claim 12, wherein the motor is disposed within the head.

27. The doll of claim 13, wherein the plural pivot axe are at least substantially perpendicular to the upright long axis.

* * * * *